US010085511B2

(12) United States Patent
Crunk

(10) Patent No.: US 10,085,511 B2
(45) Date of Patent: Oct. 2, 2018

(54) HAT VENTILATED THROUGH BRIM

(71) Applicant: William F. Crunk, San Angelo, TX (US)

(72) Inventor: William F. Crunk, San Angelo, TX (US)

( * ) Notice: Subject to any disclaimer, the term of this patent is extended or adjusted under 35 U.S.C. 154(b) by 0 days.

(21) Appl. No.: 15/418,456

(22) Filed: Jan. 27, 2017

(65) Prior Publication Data

US 2017/0215513 A1 Aug. 3, 2017

Related U.S. Application Data

(60) Provisional application No. 62/288,297, filed on Jan. 28, 2016.

(51) Int. Cl.

| | |
|---|---|
| ***A42C 5/04*** | (2006.01) |
| ***A42B 1/06*** | (2006.01) |
| ***A42B 1/24*** | (2006.01) |

(52) U.S. Cl.

CPC ..... *A42C 5/04* (2013.01); *A42B 1/062* (2013.01); *A42B 1/24* (2013.01)

(58) Field of Classification Search

CPC ..... A42B 1/062; A42B 1/24; A42C 5/04
USPC ..... 2/171.3, 195.1, 195.5, 195.6
See application file for complete search history.

(56) References Cited

U.S. PATENT DOCUMENTS

| | | | | |
|---|---|---|---|---|
| 911,432 A | | 2/1909 | Pachner | |
| 1,514,799 A | * | 11/1924 | Simonelli | A42B 1/062 2/195.5 |
| 2,874,387 A | | 2/1959 | Constance et al. | |
| 4,101,981 A | * | 7/1978 | Boden | A42C 5/04 2/171.3 |
| 4,114,201 A | * | 9/1978 | Garrison | A42B 1/062 2/209.7 |
| 4,292,689 A | | 10/1981 | Townsend | |
| 4,309,774 A | | 1/1982 | Guzowski | |
| D271,250 S | | 11/1983 | Burgin et al. | |
| 4,612,675 A | | 9/1986 | Broersma | |
| 4,766,614 A | * | 8/1988 | Cantwell | A42B 3/124 2/171.3 |
| 4,793,006 A | * | 12/1988 | Dawson | A42B 1/065 2/10 |
| 4,989,270 A | * | 2/1991 | Boughten | A42B 1/206 2/171.5 |
| 5,157,788 A | * | 10/1992 | Schultz | A42B 1/04 2/195.1 |

(Continued)

OTHER PUBLICATIONS

"Airpeak Menu", Retrieved from the Internet Jan. 27, 2017, http://www.pgashow.com/en/Exhibitors/1162344/Airpeak-Cap-by-Builmatel-Inc/Products/859783/Airpeak, 16 page.

(Continued)

*Primary Examiner* — Katherine Moran
*Assistant Examiner* — James Heracklis
(74) *Attorney, Agent, or Firm* — Scheinberg & Associates, P.C.; Michael O. Scheinberg; John B. Kelly

(57) ABSTRACT

A ventilated hat is provided that includes a crown and a brim, the brim having air passages that extends from the front and/or sides of the brim, through the brim to the crown. Air is enters the air passages at the front or sides of the brim when the wearer moves or when any slight breeze blows into the brim, cooling the wearer's head. The hat can be constructed as a single unit or as a frame upon which replaceable hat covers are mounted.

29 Claims, 10 Drawing Sheets

(56) References Cited

U.S. PATENT DOCUMENTS 5,197,150 A * 3/1993 Bedient ..... A42B 1/065 2/10
5,226,180 A 7/1993 Leach
5,365,607 A 11/1994 Benevento et al.
5,487,191 A 1/1996 Ridley
5,553,325 A * 9/1996 Gutierrez ..... A42B 1/064 2/12
5,659,896 A * 8/1997 Taylor ..... A61F 9/045 2/12
5,689,830 A * 11/1997 Pflum ..... A42B 1/065 2/10
5,771,493 A * 6/1998 Proctor ..... A42B 1/004 2/171.1
5,781,933 A * 7/1998 De Giacomi ..... A61F 9/045 2/195.1
5,819,318 A * 10/1998 Tse ..... A42B 1/22 2/10
5,855,023 A * 1/1999 Clingenpeel ..... A42C 5/04 2/181.6
5,887,289 A * 3/1999 Theoret ..... A42B 1/08 2/195.1
5,926,849 A * 7/1999 Boyle ..... A42B 1/22 2/181.2
6,061,836 A * 5/2000 Peters ..... A42B 3/003 2/175.6
6,125,472 A 10/2000 Nakagawa
6,199,214 B1 * 3/2001 Campbell ..... A42B 3/28 2/181.6
6,202,218 B1 * 3/2001 Chen ..... A42B 1/065 2/175.1
D440,743 S 4/2001 Thornell
6,308,336 B1 10/2001 Stephenson et al.
6,317,896 B1 11/2001 Timms et al.
6,367,084 B1 * 4/2002 Keast ..... A42C 5/04 2/182.7
6,370,697 B1 * 4/2002 Held ..... A42C 5/04 2/184.5
6,374,423 B1 4/2002 Anderson et al.
6,473,907 B1 * 11/2002 Harwood ..... A42B 1/064 2/12
6,526,595 B2 3/2003 Held
6,598,237 B2 7/2003 Held
D499,231 S * 12/2004 Toppel ..... D2/882
6,880,176 B2 4/2005 Timms et al.
6,904,617 B2 * 6/2005 Tsai ..... A41D 13/0053 2/209.13
6,948,189 B2 9/2005 Early
D521,713 S * 5/2006 Cho ..... D2/893
7,082,618 B1 * 8/2006 Muso ..... A42B 1/062 2/175.1
7,174,573 B1 * 2/2007 Chen ..... A42B 1/08 2/195.1
7,185,371 B2 * 3/2007 Koo ..... A42B 1/062 2/10
D541,509 S 5/2007 Sprowl
7,331,064 B1 2/2008 Quintal
7,398,560 B1 * 7/2008 Swensen ..... A42C 5/04 2/182.2
D607,629 S 1/2010 Puangprasert
7,640,601 B2 * 1/2010 Lee ..... A42B 1/063 2/195.1
D612,134 S * 3/2010 Hoffman ..... D2/872
D617,536 S 6/2010 Puangprasert
D623,831 S 9/2010 Parsons et al.
7,937,778 B1 * 5/2011 Norton ..... A42B 1/08 2/175.4
7,954,173 B2 6/2011 Collier
8,087,254 B2 1/2012 Arnold
D670,034 S 10/2012 Kolodziej
D670,891 S 11/2012 Bayley
8,640,264 B2 2/2014 Ramer
8,978,167 B2 * 3/2015 Blair ..... A42B 1/08 2/410
9,078,483 B1 * 7/2015 Snyder ..... A42B 1/064
2002/0078491 A1 6/2002 Held
2003/0084499 A1 * 5/2003 Park ..... A42B 1/062 2/195.6
2004/0006807 A1 * 1/2004 Wang ..... A42B 1/062 2/195.1
2004/0231033 A1 11/2004 Cho
2005/0132468 A1 * 6/2005 Lundgren ..... A42B 3/28 2/171.3
2005/0273906 A1 * 12/2005 Kim ..... A42B 1/062 2/195.7
2006/0005300 A1 * 1/2006 St-Germain ..... A42B 1/062 2/209.13
2006/0031978 A1 * 2/2006 Pierce ..... A42B 3/06 2/414
2007/0017003 A1 * 1/2007 Harris ..... A42B 1/064 2/195.1
2008/0163406 A1 * 7/2008 Solari ..... A42B 1/008 2/209.13
2009/0049578 A1 * 2/2009 Toyohiro ..... A41D 27/13 2/69
2009/0205108 A1 * 8/2009 Ross ..... A42B 1/067 2/172
2009/0241240 A1 * 10/2009 Han ..... A42B 1/062 2/182.8
2009/0288238 A1 * 11/2009 Greene, Jr. ..... A42B 1/062 2/171.3
2011/0030124 A1 * 2/2011 Zhen ..... A42B 1/24 2/209.13
2011/0061145 A1 * 3/2011 Zuloff ..... A42B 1/24 2/209.13
2011/0252539 A1 * 10/2011 Scott ..... A42B 1/062 2/209.5
2012/0000006 A1 * 1/2012 Ramer ..... A42B 1/062 2/171.3
2012/0278969 A1 11/2012 Aronson
2013/0033852 A1 * 2/2013 Liao ..... A42B 1/24 362/106
2013/0192961 A1 * 8/2013 Waters ..... A42B 1/244 200/43.18
2013/0263358 A1 * 10/2013 Fleischmann ..... A42B 1/008 2/182.8
2014/0304891 A1 * 10/2014 Waters ..... A42B 1/24 2/209.13
2014/0338097 A1 * 11/2014 Kay ..... A42B 1/064 2/195.1
2015/0000008 A1 * 1/2015 Shirai ..... A42B 1/008 2/195.1
2015/0020292 A1 * 1/2015 Diaz ..... A42C 5/04 2/171.2
2015/0033444 A1 * 2/2015 Heard ..... A42B 1/22 2/209.12
2015/0150328 A1 6/2015 Knight
2016/0157542 A1 * 6/2016 Lee ..... A42B 1/008 2/171.3

OTHER PUBLICATIONS

"Airpeak", Retrieved from the Internet Jan. 27, 2017, http://www.pgashow.com/_novadocuments/196207?v+635881824339730000, 1 page.
"Airpeak", Retrieved from the Internet Jan. 27, 2017, http://www.pgashow.com/en/Exhibitors/1162344/Airpeak-Cap-by-Builmatel-Inc/Products/859783/Airpeak, 1 page.

* cited by examiner

HAT VENTILATED THROUGH BRIM

TECHNICAL FIELD OF THE INVENTION

The present invention relates to headwear, and in particular to ventilated headwear.

BACKGROUND OF THE INVENTION

Hats worn in hot weather keep the sun off of people's heads can warm up the wearer's head by trapping generated heat. There have been many attempts to produce headwear that keep the wearer's heads cool by providing air flow to the wearer's head.

For example, U.S. Pat. No. 7,398,560 for a "Hat/visor with Brim Vent" describes headwear, such as a hat, cap, or visor, with a headband and a brim extending outwardly. The hat includes a crescent shaped opening defined by an inner portion of the brim and an external leading edge of the headband that provides venting at the base of the visor.

U.S. Pat. No. 6,880,176 for "Headgear" describes an improved headgear includes an outer shell and an inner liner providing a head receiving cavity. A headband has a forward portion and lateral portions secured to the inner liner and a rearward portion extending rearward of said lateral portions. A first vent aperture is centrally formed in the outer shell. A second vent aperture is centrally formed in the inner liner. Third vent apertures are formed in the inner liner in spaced relationship with the second vent aperture.

U.S. Pat. No. 6,598,237 for a "Selectively Removable Device to Promote Circulation of Air into and Out of a Hat" describes a device that allows air to circulate. The device has a base having an arcuate first side and a second side. The second side has a rib extending from the second side. The device also has a surface adapted for attaching the base to a hat. Air enters at the base of the visor next to the head.

U.S. Pat. No. 6,317,896 for a "Headgear" describes an improved headgear that includes an outer shell and an inner liner providing a head receiving cavity. A headband has a forward portion and lateral portions secured to the inner liner and a pair of rearward extending flexible members having interconnecting free end portions that allow the headband to be adjusted to many heads of different length. A fabric lining covers the headband forward and lateral portions and has slot openings through which the headband flexible members extend. An adjustable opening at the top of the fabric lining facilitates headgear vertical adjustment. A pair of side retention straps extend downwardly from the sides of the outer shell. A pair of rear retention straps mount to respective ones of the side retention straps and are adjustably secured to each other. The inner liner has channels that receive the side retention straps and allow them to drape down in close proximity to a wearer's temples and cheeks.

U.S. Pat. No. 5,487,191 for a "Vented Visor Cap" describes a cap or hat having a visor for permitting a flow of air through the visor, thereby precluding unintentional removal of the cap by wind currents. The cap has a visor extending outwardly therefrom, with the visor having a semi-circular aperture extending therethrough. A venting assembly extends across the visor aperture and is secured to forward and lateral edges of the visor aperture only, thereby allowing a trailing edge of the venting assembly to be fluidly biased out of the plane of the visor such that a pressure differential across the visor is reduced. The flow of air through the visor is perpendicular to the plane of the visor.

U.S. Pat. No. 5,157,788 for a "Ventilated, Heat Attenuating Headwear" describes a ventilated, heat attenuating hat including an inner mesh section that has a crown portion for engaging the crown of a wearer's head and a pair of side portions connected to the crown portion for engaging the sides of the wearer's head. There is an outer mesh section interconnected to the inner mesh section for covering at least a portion of the inner mesh section. A channel is formed between the inner and outer mesh sections for allowing air to flow freely therethrough. The outer mesh section includes a metallized fabric for reflecting away from the hat a significant of solar radiation that strikes the outer mesh section.

U.S. Pat. No. 4,309,774 for a "Ventilating Helmet" shows a ventilating helmet which takes the form of sheet material wall member which has mounted thereon an electrically operated fan which is adapted to move air to the interior of the helmet. The electrically operated fan is to be operated through the use of a light sensitive, electrical energy producing cell. This cell is to be directly exposed to the source of light energy.

U.S. Pat. No. 4,292,689 for a "Visored Hat Construction" describes a visor having an open cell construction that blocks sunlight from the wearer's eyes.

U.S. Pat. Pub. 2009/0049578 describes a hat having a water absorbing material sandwiched in the brim or other portion of the hat. As the water evaporates through vents, cooling the region of the hat against the wearer's head.

U.S. Pat. Pub. 2012/0000006 to Ramer for "Utilising an Airfoil Effect for Inducing Cooling in a Baseball Cap, A.K.A. 'Air Cap'" describes a hat having two brims, which is claimed to create an airfoil effect between the two brims. The hat includes a normal-sized main visor or bill in the front with a crown of material over the head, the main bill being deliberately curved upwards where it is attached to the crown. The hat also includes a short, flat, second bill placed underneath the main bill, with the second bill attached to the interior brim of the cap at the back of the bill. The second bill is also attached to the main visor on the sides and a gap exists between the two bills from front to back.

Another cap is the Airpeak by Builmatel of Japan. The Airpeak includes an conspicuous opening in the center, not the front of the brim. The prominent opening severely affects the aesthetics of the cap.

Some prior art caps include a large air intake on the top of the brim, which many wearer's may not find aesthetically displeasing.

Designs for ventilated hats include U.S. Des. Pat. No. D670,891 for a "Ventilated Hat" which shows a circular hard hat with a hanging screen on the back—no front visor. A bill extends all the way around with a fan in the front, blowing down towards the forehead. In U.S. Des. Pat. No. D670,034 for a "Vented Construction Hard Hat," shows vents entirely in the crown of the hat. U.S. Des. Pat. No. D623,831 for a "Ventilated Hat with a Sunshade Brim" shows venting around the head. U.S. Des. Pat. No. D617,536 for a "Ventilated Hat" shows venting is at the top, with front-to-back strips covering front-to-back openings underneath. U.S. Des. Pat. No D607,629 for a "Ventilated Hat" shows vents are on the top. D541,509 for a "Ventilated Decorative Hat" describes vents that appear to be holes in the part of the hat covering the head.

SUMMARY OF THE INVENTION

An object of the invention is to provide headwear that provides airflow to the wearer's head through the brim.

In a preferred embodiment, a hat includes a brim having air passages conducting air entering the brim to the wearer's head. In some embodiments, a hat includes two parts, a base portion that includes a brim with air passages and a removable hat cover that can be exchanged to alter the aesthetics of the hat.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which.

DETAILED DESCRIPTION OF PREFERRED EMBODIMENTS

Some embodiments effect little or no change to the aesthetics of a conventional hat. For example, in an embodiment that comprises a baseball cap-type hat with a brim through which air can flow, the gap in the brim through which air flows may be sufficiently thin that the brim appears to be a normal hat brim. The gap may be covered with a thin fabric that allows air to flow and that hides the gap, contributing to maintaining the appearance of a conventional hat. The gap height, that is, the distance between the bottom surface of the upper brim and the upper surface of the lower brim, through which the air can flow, can vary in different embodiments. A small gap provides a more conventional appearance of the hat which can improve the aesthetics of the hat. A larger gap height provides increased airflow. The invention is not limited to a particular gap height. In some embodiments, the gap may as small as ⅛ of an inch or smaller or as large as one inch or larger. A typical gap height would be between about ¼ inch to about ½ inch.

The brim comprises a single brim with a gap within the single brim. Single brim embodiments of the present invention include primarily a single upper surface exposed to the air and a single lower surface exposed to the air, with an interior gap between the upper surface and the lower surface. Minor variation in the lengths of the extension of the upper surface and the lower surface are still within the scope of the definition of a single brim. A "double brim" by contrast, such as the hat described in US Pat. Pub. 2012/0000006, includes two independent bills, each having an upper exterior surface and a lower exterior surface that are exposed to the environment. The single brim has a more pleasing appearance than the double brim hat, and appears more like a convention cap.

Moreover, the upper and lower elements of the brim extend outward from the wearer's head by the same amount or by approximately the same amount, that is, to within 1 inch, more preferably to within ½ inch, even more preferably to within ¼, and most preferably to within ⅛ of an inch. The upper and lower brim element of the single brim are approximately the same size, that is, the upper brim element and the lower brim elements have approximately the shape and are, but are displaced from each other by the brim gap. The distance between the upper and lower elements of the single brim is preferably approximately constant. The curvatures of the upper and lower brim elements are preferably approximately the same.

Figure 1:
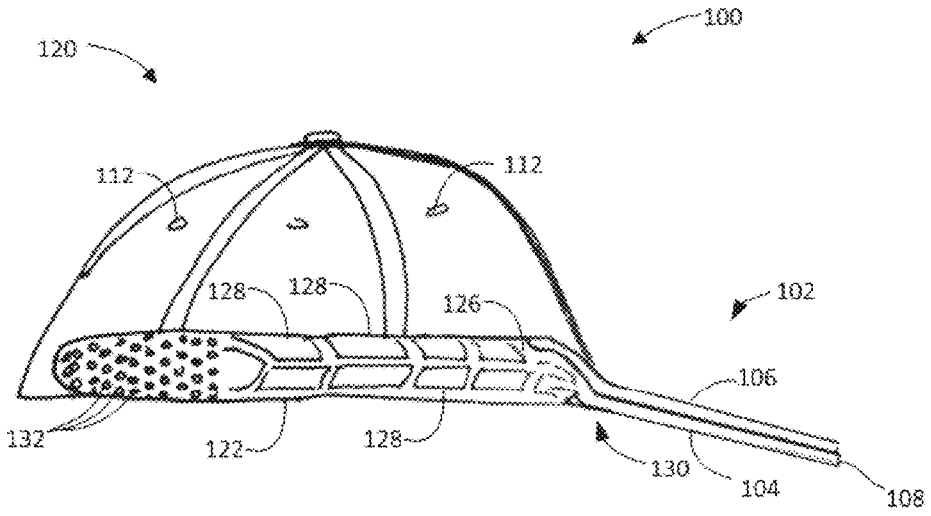
FIG. 1 shows a partial cutaway view of a cap embodying the invention.

FIG. 1 shows a partially cut-away view a cross section of a hat 100 that includes a brim 102 having a lower brim element 104 and an upper brim element 106 spaced apart from the lower brim element 104 to create a brim gap 108. Hat 100 includes a crown 120 including a lower crown ventilation portion 122 that includes multiple spacers 128 forming a crown gap 126 through which air flow can be guided by spacers 128. Air enters the brim gap 108 from the front and/or sides of the brim and at least some of the air is conveyed around the side and towards the rear of the wearer's head through lower crown ventilation portion 122. Between the brim 102 and crown 120 is a transition region 130 in which air from the brim moves into the lower crown ventilation portion 122 and/or toward the front of the wearer's head. Vent holes 132 allows air from lower crown ventilation portion 122 to exit toward the wearer's head. Holes 112 can optionally be provided in crown 120.

In some embodiments, spacers or air flow guides within the brim or crown comprise a single material that extends through the brim and/or sides and into the crown. In other embodiments, the brim air flow guides stop at the back of the brim and crown air flow guides start at the front and/or side of the crown. Other embodiments may lack lower crown ventilation portion 122, and may deliver air at the rear of the brim directly to the wearer's head. Air flow through the brim may be caused by a breeze, by movement of the wearer, or by convection, rather than being driven by a powered device, such as a fan. In some embodiments, the entire hat 100, including brim 102 and crown 120, are permanently joined together. In other embodiments, brim 102 and lower crown ventilation portion 122 comprise one unit and a replaceable hat cover includes the remainder of the crown.

For aesthetic purposes, the crown 102 is relatively thin. Preferably less than ½" thick, more preferably less than ⅜" thick, and most preferably around ¼" thick. Gap 108 can be covered with a mesh or cloth that is thin enough to pass air into the brim gap, but that hides the opening of gap 108. A sheer fabric, such as a diaphanous fabric which is made using thin thread and/or low density of knit can cover the gap.

Figure 2:
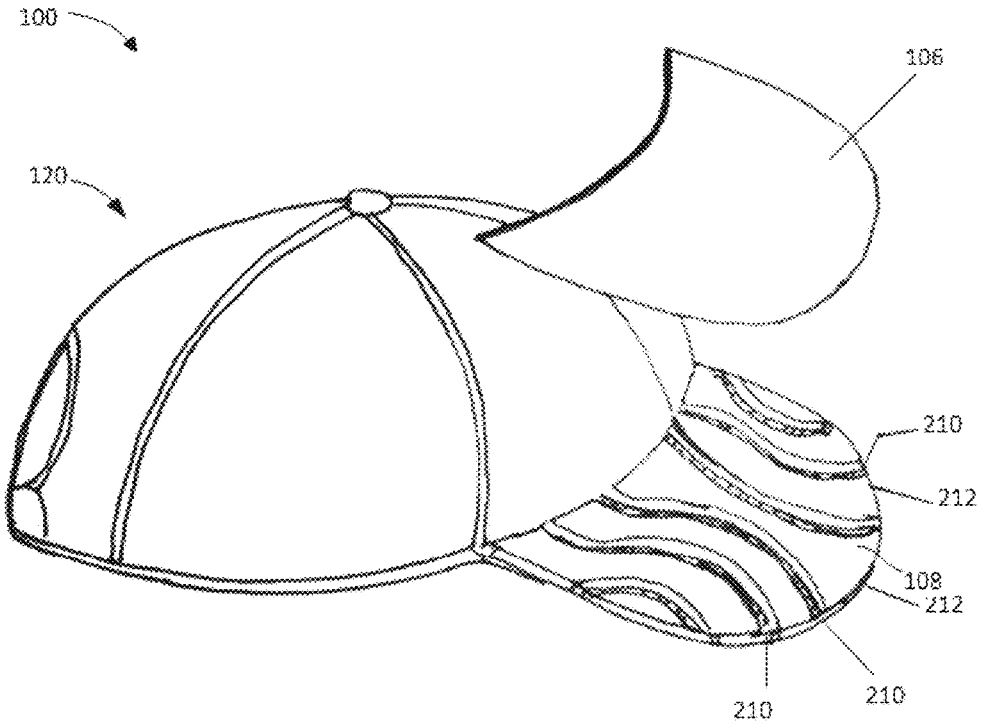
FIG. 2 shows the cap of FIG. 1 with the brim removed.

FIG. 2 shows hat 100 with upper brim element 106 removed to show multiple spacers or brim air flow guides 210 positioned in the brim gap 108. The passages allow air to flow from the front or sides of the brim to the back of the brim and into the crown. Channels 212 are defined between the brim air guides 210. The air flow passages have a width defined in the direction normal to the air flow. In some embodiments, the width of at least one of the air flow passages decreases and then increases from the front of the brim and to the back of the brim. That is, channel 212 alternately narrows and then widens, which is thought to increase the air flow to the user's head. In other embodiments, the brim is formed of multiple parallel passage. The gap between the upper brim and the lower brim can be maintained, for example, by a corrugated material that provides multiple air passages using, for example, multiple thin members extending from upper brim to the lower brim. In other embodiments, the upper brim and lower brim elements are sufficiently rigid that the gap is maintained without the use of spacers or other spacers within the brim.

Figure 4A:
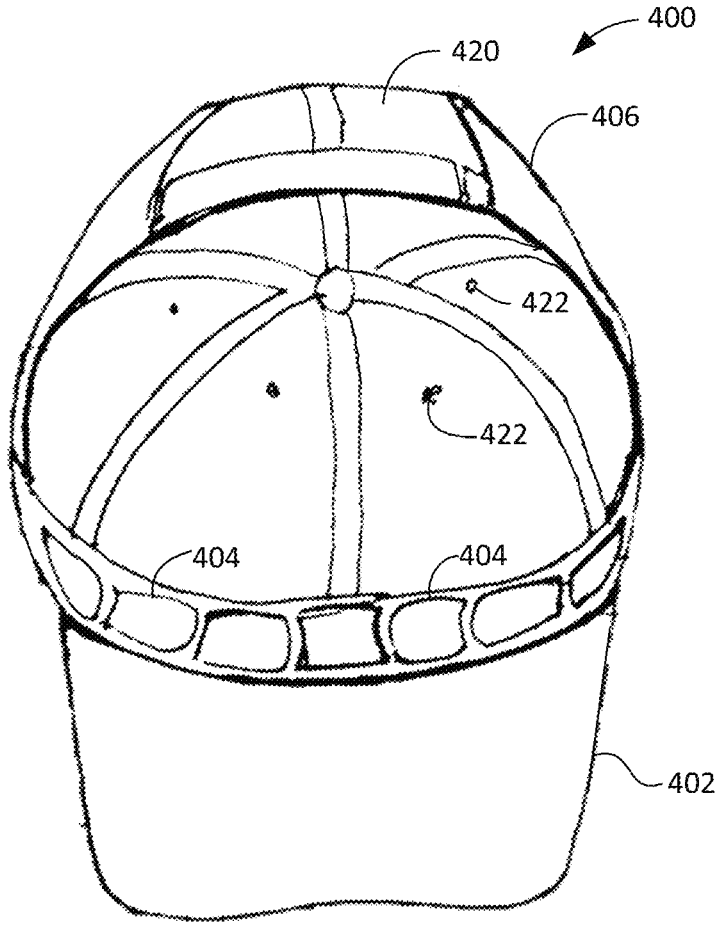
FIG. 4A shows a bottom view of the inside of a hat of the present invention.
Figure 4C:
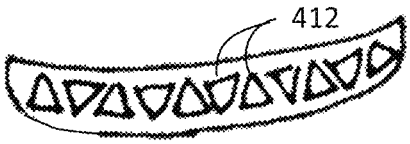
FIGS. 4B and 4C shows alternative vent shapes that could be used in place of the vents in the hat in FIG. 4A.
Figure 4B:
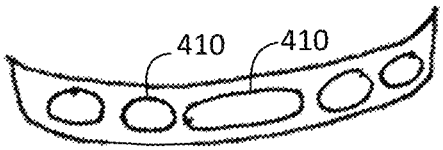

FIG. 4A shows a bottom perspective view of the inside of a hat 400. Brim 402 has air passages (not visible) that lead to air holes 404 under crown 406. Air from the brim travels through passages in the brim and exits through air holes 404 into a gap between the crown the wearer's head. In some embodiments, airflow guides in the crown channel the air from one or more vent holes 404 to spread the air around and over the wearer's head. FIG. 4B shows an alternative design of vents 410 at the inside front of the crown. FIG. 4C shows another alternative design in which the air holes comprise triangular vents 412. An opening 420 at the back of the hat and openings 422 in the crown allow air to exit. The embodiment of FIG. 4A does not include a lower crown ventilation portion 122, so all the air is delivered near the front of the crown.

Figure 6B:
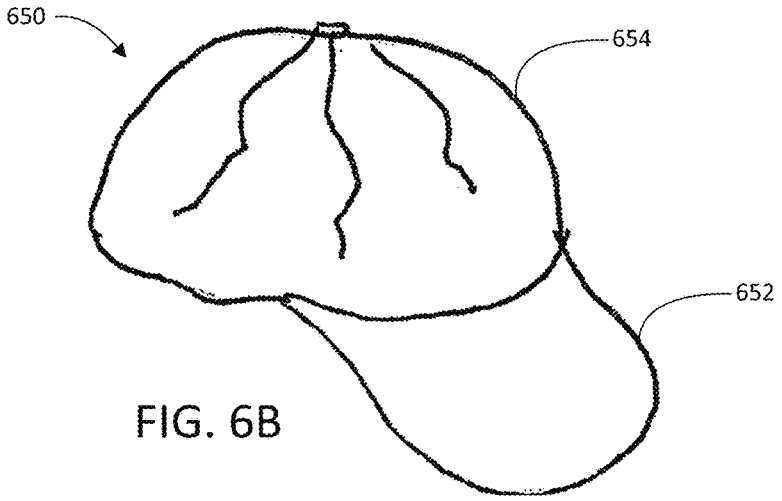
FIG. 6B shows a removable hat cover for use with the base of FIG. 6A.
Figure 5:
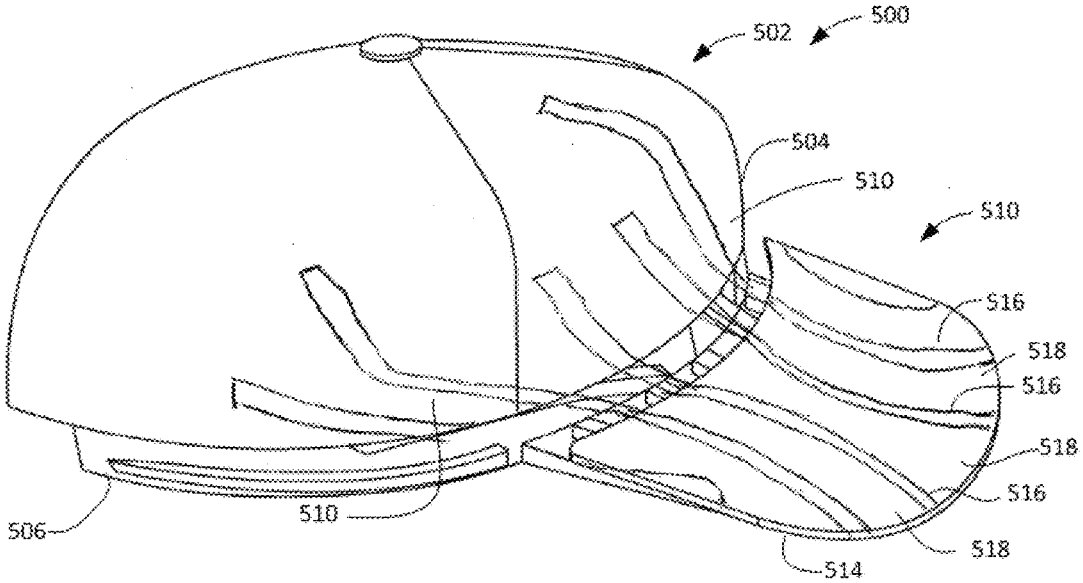
FIG. 5 shows a hat with a portion of the upper brim element and the upper crown element removed to show the air guides.

FIG. 5 shows another hat 500 with a crown 502 having an upper crown portion 504 and a lower crown portion 506, and a brim 510 having a lower brim portion 514 and an upper brim portion, which has been removed to show air guides 516 that define air passage 518. Some of air guides 516 extend through the brim 510 and into the crown 502 to conduct air from the front or side of the brim through air passage and into brim air passage 518 around the wearer's head (not shown). Each guide can be constructed from a single length of material that extends through from the front of the brim and into the crown, or the brim guide can terminate at the end of the brim and the crown guides can be constructed of separate pieces of material in the brim, with the guides in the brim and the crown aligning to conduct air smoothly through the brim and into the crown. Hat 500 can be constructed as one piece or the upper crown portion 504 and upper brim portion can be formed as a removable hat cover FIG. 6A shows an embodiment that comprises a base portion 600, referred to as a WindBrim™ over which a removable cover, 650 (FIG. 6B), referred to as a WindSkin™, is mounted. Base portion 600 includes a brim portion 602 and side extension portions 604 that extends from the brim portion 602 on either side of the wearer's head (not shown) toward the back. Brim portion 602 includes an upper brim portion 606 and a lower brim portion 608 separated by a spacer (not shown) to form a brim gap 610 having a front opening 612 and optional side opening 614. The spacer may comprise multiple air flow guides, examples of which are shown in FIG. 2. Air enters the brim gap 610 from the front or the side of the brim and at least some of the air travels through the side extensions 604 and out through holes 628.

Extensions 604 include air guides 622 that define air passages 626 to guide some of the air from the brim portion 602 toward holes 628 toward the rear of extensions 604. Removable cover 650 includes a brim portion 652 and a crown portion 654. The two extensions 604 are essentially mirror images of one another. Brim portion 652 includes a pocket (not shown) that slips over brim portion 602 of base 600. Brim portion 652 includes an opening in the front aligned with front opening 612 in brim portion 602 and optionally, openings in the sides aligned with side openings 614 of base 600. Alternatively, the portion of brim portion 652 that covers openings 612 and 614 may be constructed of a thin fabric that allows the passage of air, yet visibly obscures the openings in brim portion 602.

Crown portion 654 also include pockets (not shown) to accept extension portion 604. Brim portion 652 is preferably formed of a non-rigid material, such as an unreinforced fabric. Brim portion 602, which is more rigid, provides shape to, and supports, brim portion 652 when mounted. Similarly, crown portion is formed of a non-rigid material, such as an unreinforced fabric. Crown portion 654 may be similar in construction to the crown portion of a conventional cap, although crown portion 654 includes a pocket or other connector for connecting crown portion 654 to base 600.

Multiple replaceable covers 650 allow a user to change the appearance of a hat without having to replace the base 600.

Figure 6C:
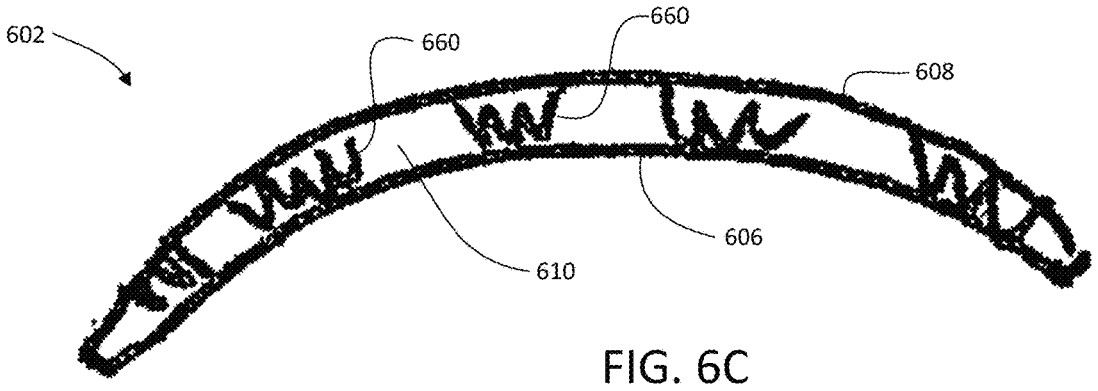
FIG. 6C shows the front of a hat brim including a brim gap; brim and side extension, the brim supporting hat having a replaceable brim cover.
Figure 3:
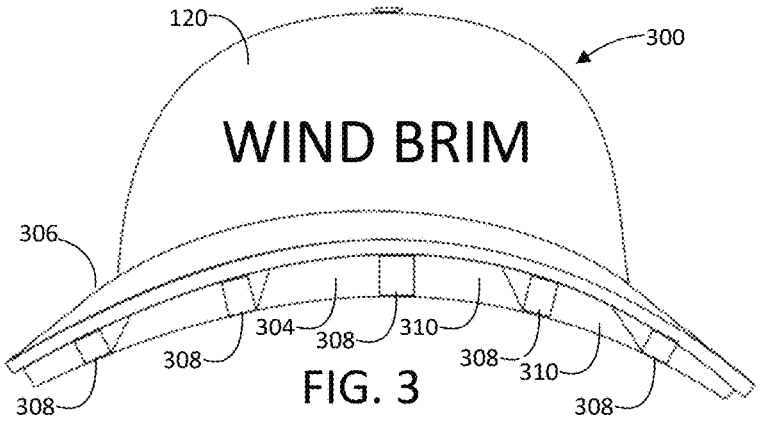
FIG. 3 shows a front view of a cap.
Figure 6A:
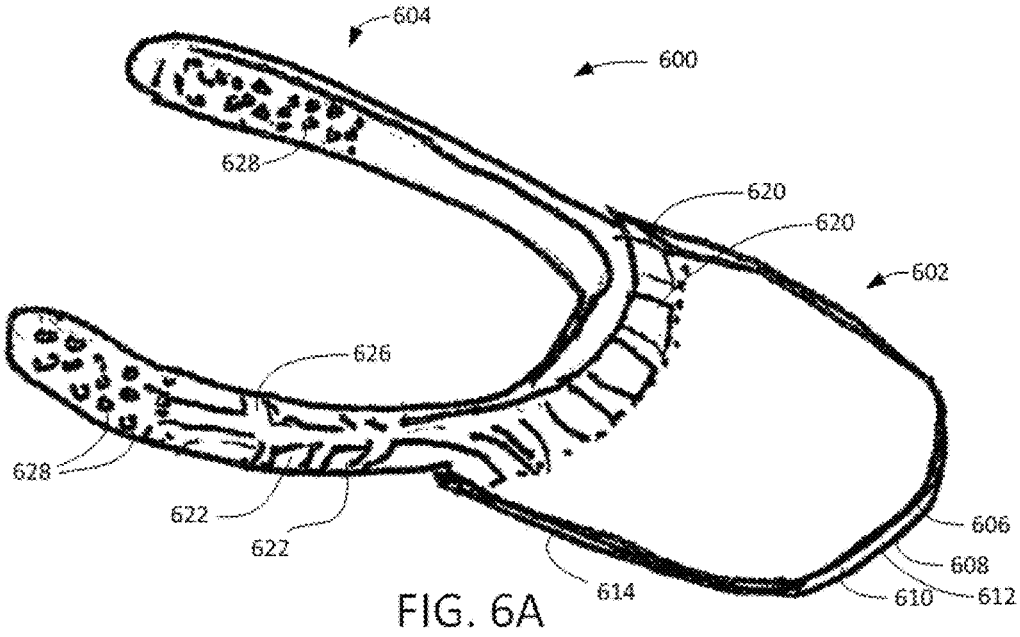
FIG. 6A shows a base for supporting a removable hat cover.

FIG. 6C is a front view of an example of a brim opening 610, showing lower brim portion 606 and upper brim portion 608. Spacers 660 maintain the air gap 610. Spaces 660 are shown as corrugated. In other embodiments, spacers 660 may be solid. Spacers 660 not only maintain the gap 610, they may also direct air within brim 602. FIG. 3 is a front view of a hat 300 showing lower brim element 304, an upper brim element 306 spaced apart from the lower brim element by air flow guides 308 to create a brim gap 310.

Figure 7A:
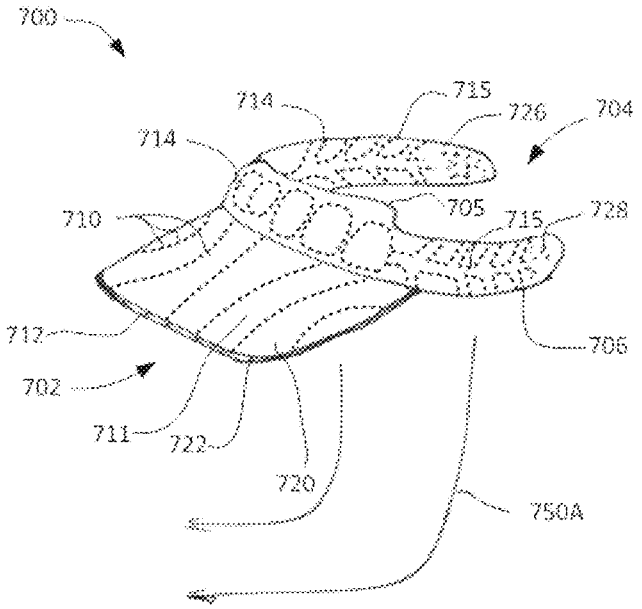
FIG. 7A shows a base for supporting a removable hat cover.

FIG. 7A shows a base portion or a brim frame 700 similar to that shown in FIG. 6A and having a brim portion 702 and a crown base 704 that includes a crown stub portion 705 that extends upwards at an angle from the brim portion 702, and side extensions 706 that extend rearward toward the back of the wearer's head. An upper brim portion 720 and a lower brim portion 722 are separated by brim spacers 710 (shown in dotted lines as they are hidden by upper brim portion 720) to provide a brim gap 712. Similarly, crown base 704 includes an inner portion 726 and outer crown portion 728, separated by crown base spacers 714 (shown in dotted lines as they are hidden) to maintain a gap in the crown base 704. Brim spacers 710 may define air passages 711 with the brim gap 712 and crown base spacers 714 may define air passages 715 within the crown base gap. Air flows through brim portion 702 to crown base 704, some of the air flowing through side extensions 706 to the wearer's head and some of the air flowing through crown stub portion 705 to the wearer's head.

Figure 7B:
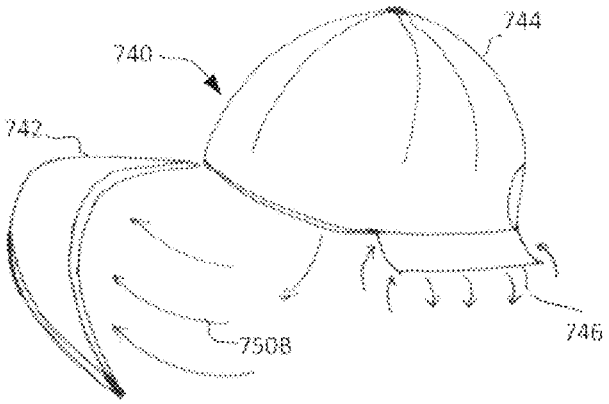
FIG. 7B shows a removable hat cover with the brim portion shown separated to show a brim pocket for insertion of the brim of FIG. 7A.
Figure 7C:
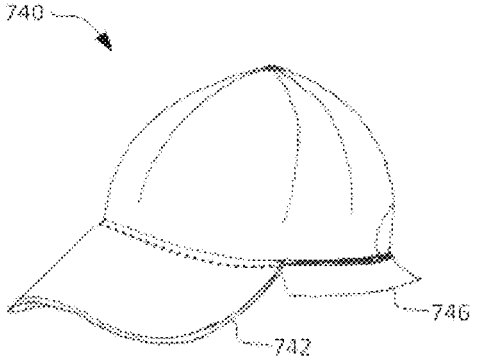
FIG. 7C shows a removable hat cover for use with the base of FIG. 6A.

FIG. 7B a replaceable hat cover 740 with a brim portion 742 shown separated from a crown portion 744 to illustrate how the brim frame 700 is inserted into a "pocket" in the rear of brim portion 742. Arrows 750A of FIG. 7A and corresponding arrow 750B of FIG. 7B show the motion to insert the brim frame 700. Flap portion 746 of replaceable hat cover 740 can form a sleeve through which side extensions 706 can be inserted to attach replaceable hat cover 740 to a brim frame 700. The sleeve can be sown into flap portion 746 or the sleeve can be formed by attaching flap portion 746 to the inside of crown portion 744, such as by sowing or by using a fastener, such as Velcro® itself, so that the sleeve is formed between flap portion 746 and the inside of crown portion 744. The sleeve does not need to be closed for the entire length, as long as there is at least one closed loop through which extension portion 706 can be inserted. The sleeve preferably opens for easy insertion of the side extensions 706 after insert of brim portion 702 into the brim portion 742 and then closes to secure side extensions 706. FIG. 7C shows removable hat cover 740 with flap 746 and brim portion 742.

Figure 8A:
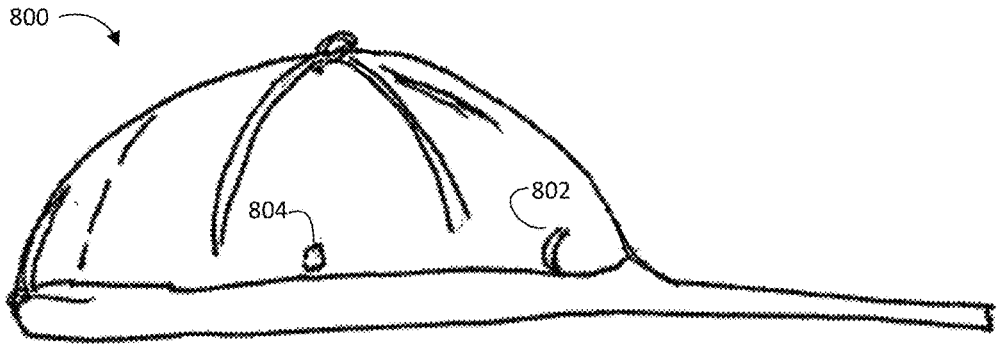
FIGS. 8A, 8B and 8C show another embodiment of a hat that includes an air scoop for scooping up air into the interior of the hat and having holes for inserting the temple tips of sunglasses or other eye glasses to the hat.
Figure 8B:
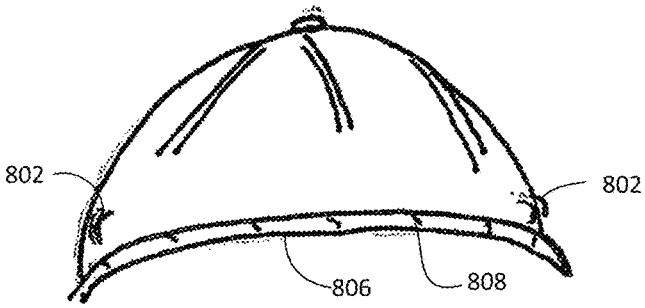
Figure 8C:
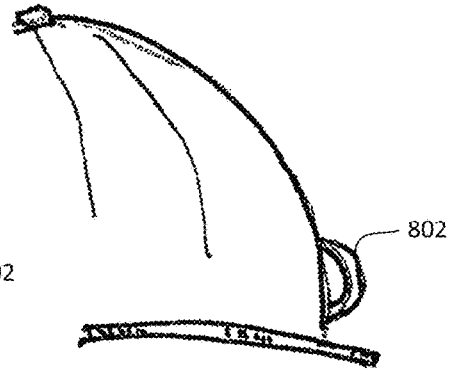

FIGS. 8A, 8B and 8C show another embodiment of a hat 800 that includes an air scoop 802 for scooping up air into the interior of hat 800. Inside the hat, the air can be conducted through air passages, such as air passages 126 in FIG. 1 and air passages 626 in extension 604 (FIG. 6A). People who wear eyeglasses, including sunglasses, will sometimes rest their glasses on the top of a hat when not in use. Hole 804 provides a place for insertion of the temple tips of eyeglasses. This provides stability for the eyeglasses supported on the top of the hat.

Not every embodiment will include both side extensions and a crown portion to provide air both the top and to the side of the wearer's head. Embodiments can include one or both portions.

Figure 9A:
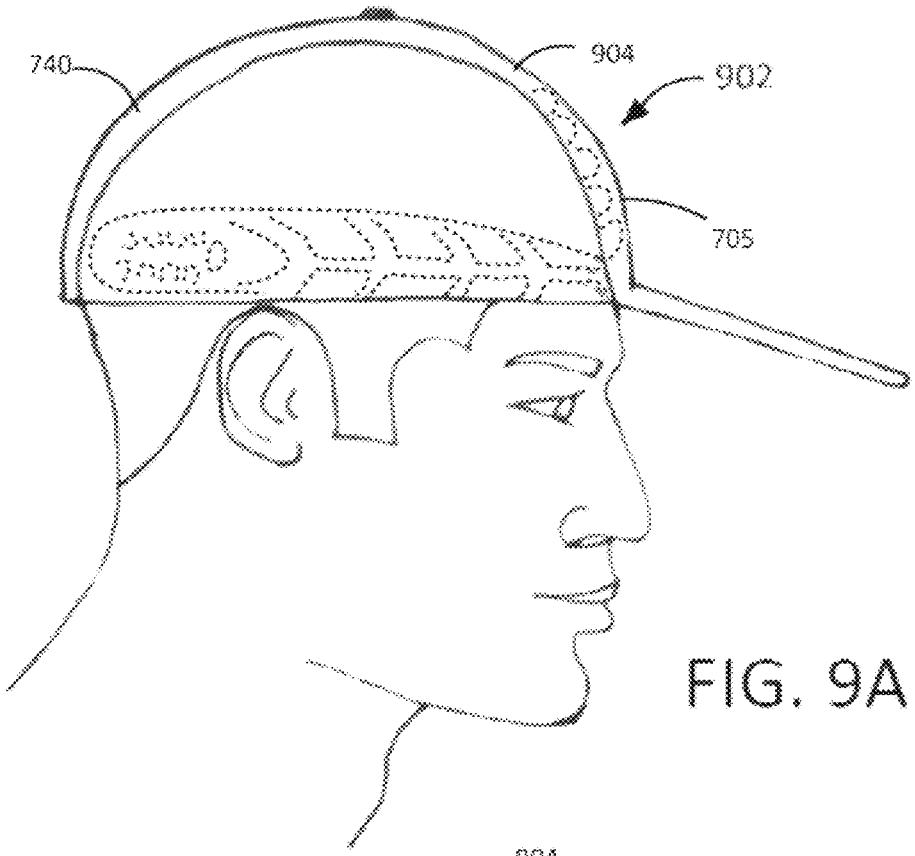
FIGS. 9A and 9B show a hat over a wearer's head.
Figure 9B:
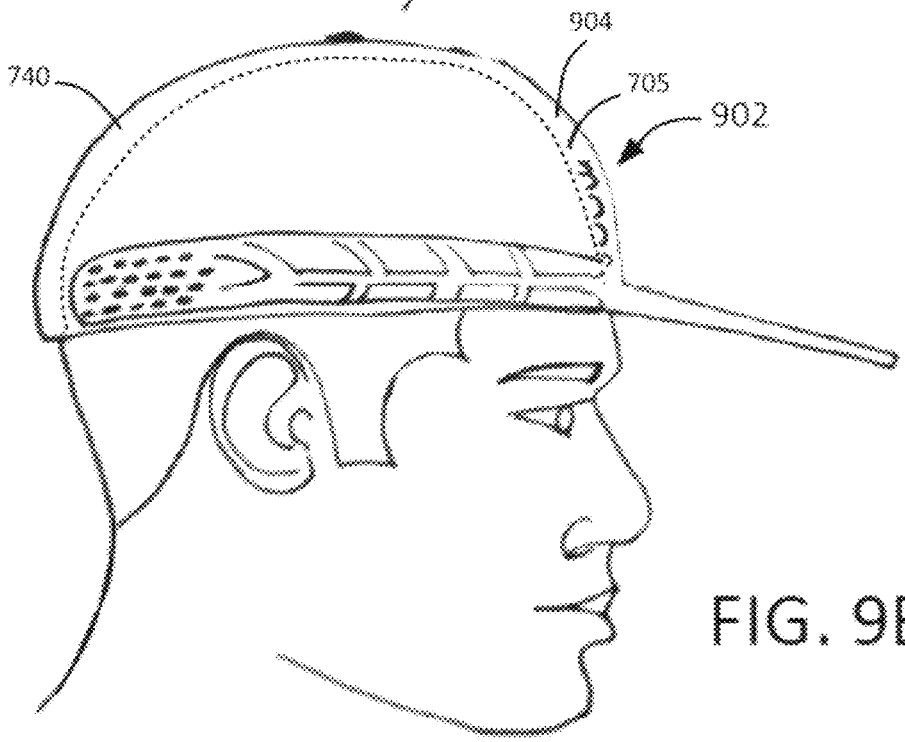

FIGS. 9A and 9B show a hat on a wearer's head. Items not labelled in FIGS. 9A and 9B are similar to those shown on earlier figures. FIGS. 9A and 9B show that the crown sits loosely and slightly away from the wearer's head, which allows air to flow over the wearer's head. Optionally, spacers 902 keep a portion of the crown off the wearer's head to allow air that has passed through the brim gap over the wearer's head. The crown stub portion 705 keep the cloth crown spaced from the wearer's head to provide space for air from the brim to flow between the crown and the wearer's head. That is, when the replaceable hat cover 740 is placed over the brim frame, the thickness of the crown stub portion of the brim frame keeps the hat cover offset from the wearer's head. Where the replaceable hat cover extends past the crown stub portion, the offset provides a gap 904 through which air can flow. Because the replaceable hat cover is flexible, the gap will not be uniformly maintained all around the wearer's head. The crown portion of the replaceable hat cover will likely contact the wearer's head in multiple places, but the fit between the crown portion of the replaceable hat cover and the wearer's head is sufficiently loose to provide gaps through which air can flow over the wearer's head. In some embodiments, spacers may maintain the crown portion of the replaceable hat cover off the wearer's head to provide space for airflow. In some embodiments, a lip or other structure at the rear of the brim keeps the crown portion away from the wearer's head to facilitate air flow over the wearer's head.

Figure 10:
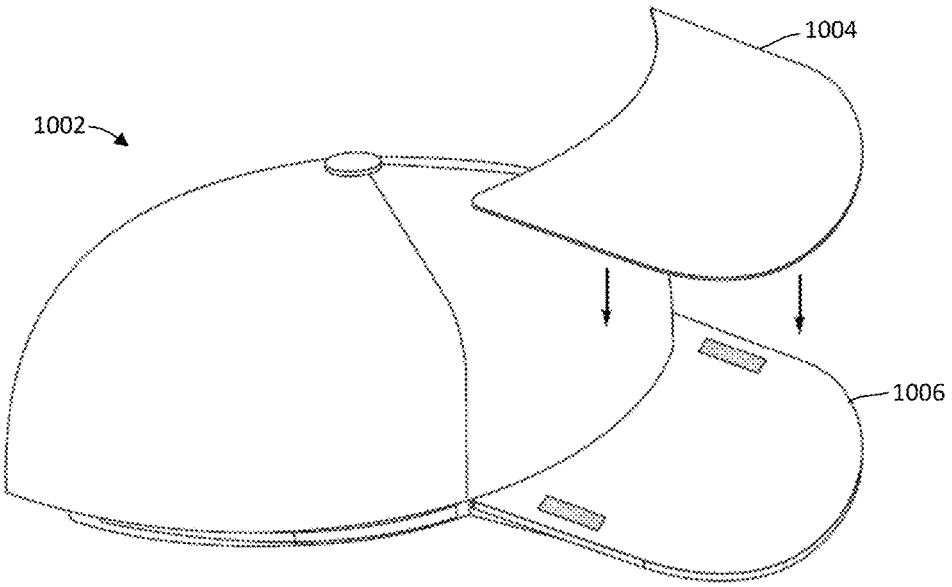
FIG. 10 shows a hat with a removable brim cover.

FIG. 10 shows a hat 1002 having a removable brim cover 1004 that attaches to the upper brim 1006 and is retained by retainers 1008, which can be, for example, hook and loop fasters, with the one element on the upper brim and the mating element on the brim cover. Interchangeable brim covers 1004 allow a user to change the aesthetics of the hat 1002.

Figure 11A:
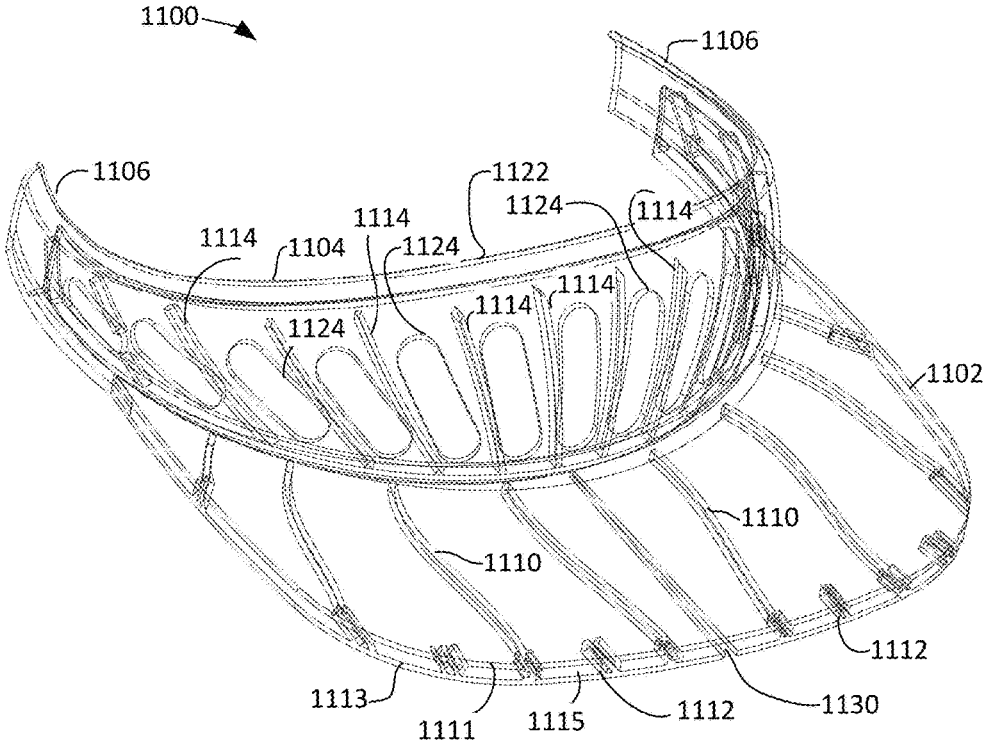
FIGS. 11A and 11B shows another embodiment of a base portion.
Figure 11B:
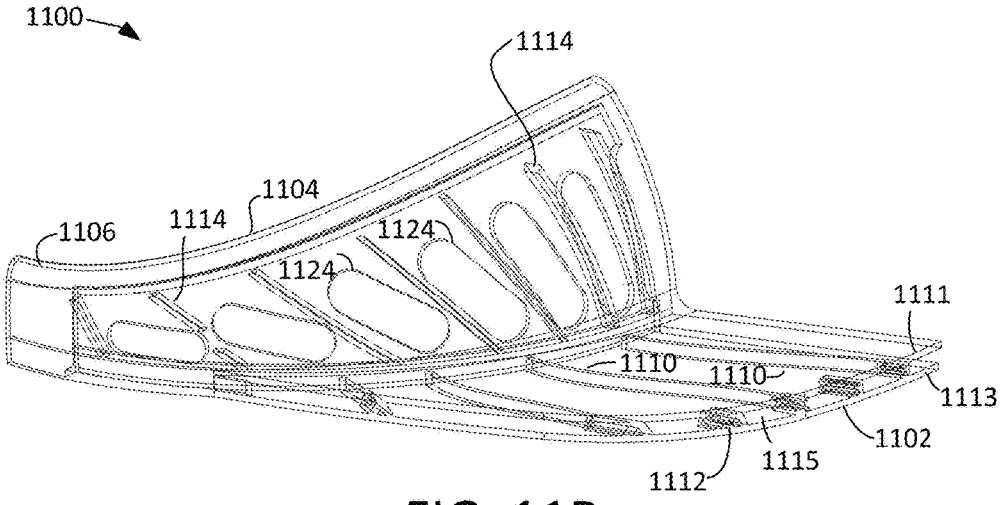

FIGS. 11A and 11B are wire frame drawings that show another embodiment of a base portion 1100 that includes a brim portion 1102, a crown portion 1104 that extends upward from the brim portion and side portions 1106 that extend rearward from the crown portion 1104. FIG. 11B shows a portion of the base portion 1100 of FIG. 11A from a different angle. Like the base portions of FIG. 1 and FIGS. 9A and 9B, the base portion is configured to receive a replaceable hat cover, such as hat cover 740 (FIG. 7), which includes a portion for receiving brim portion 1102, covering crown portion 1104, and extending over the wearers head like a conventional cap. The base portion provides passages for air to flow from the front and/or sides of the brim onto the front and side of the wearer's head under the crown of the hat. In some embodiments, the hat cover is replaceable, allowing the appearance of the hat to be changed while retaining the base portion. In other embodiments, the hat portion is permanently attached to the base portion.

Figure 12:
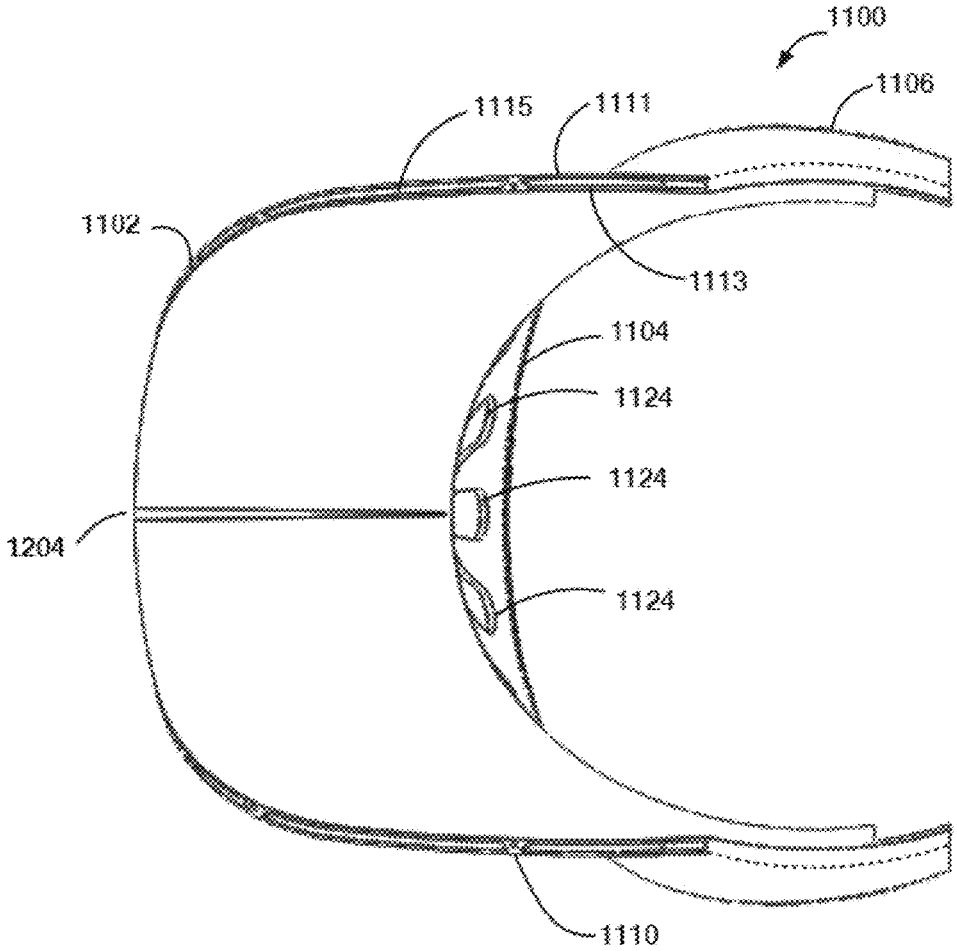
FIG. 12 shows a bottom view of the base portion of FIGS. 11A and 11B.

Brim portion 1104 includes air guide-spacers 1110 that separate an upper brim element 1111 from a lower brim element 1113 and guide airflow through a gap 1115 in the brim. Additionally, spacers 1112 at the front of brim portion 1102 assist in the separation of the upper brim element from the lower brim element. Spacers/air guides 1114 in the crown portion 1104 separate a front surface 1120 of crown portion 1104 from a rear surface 1122 of crown portion 1104 to provide a path for the passage of air. Air flows from the front and/or side of the brim, through the brim portion, and through the crown portion. Oval openings 1124 allow air to flow from crown portion 1104 and side portions 1106 to the wearer's head to cool the wearer. In manufacturing a cap, the crown portion is typically formed by sewing together multiple pie-shaped panels. Eyelets and a sweat band are typically sewed into the crown, which is then attached to the brim portion. The upper element of the brim and the lower element of the brim are typically parallel and spaced apart. When the brim is bent, the upper and lower portions would tend to converge, reducing or eliminating the gap between them and reducing the air flow through the brim. To prevent the constriction, one or more joints can be formed in the upper brim, the lower brim or both brims. Joint 1130 is shown in FIG. 11A. FIG. 12 shows a base portion 1100 as seen from the bottom. Joint 1130 is visible in brim portion 1102 includes a joint 1204 to facilitate manufacturing. Oval opening 1124 are visible on the part of crown portion 1104 that faces the user's head.

The invention includes a method of providing a wearer's head protection from the sun while keeping the wearer's head cool, comprising providing a hat having a brim and a crown, the brim having air passages that pass air from the front and/or sides of the brim to inside of the crown; and causing air to flow through the brim and to the wearer's head inside of the crown.

An advantage of some embodiments of the invention is that the embodiments provide ventilation without significantly altering the aesthetics of the hat. The hat can appear from the outside like an unventilated hat, with only a small variation in the brim.

While the embodiment shown above comprises a cap, the invention can be implemented in other types of headwear having brims, such as cowboy hats and helmets.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. A ventilated hat, comprising:

a hollow base frame including:

a frame brim portion including a brim gap; and a frame crown portion including:

a first side extension extending rearward from one side of the frame brim portion; and a second side extension extending rearward from the other side of the frame brim portion; and a removable cover, the removable cover including a cover crown portion and a cover brim portion, the cover brim portion covering the frame brim portion and the cover crown portion covering the first side extension and the second side extension and extending between the first side extension and the second side extension over the top of the wearer's head;

the brim gap having a brim gap opening to allow air to flow into the brim gap and from the brim gap into the first side extension and the second side extension, the brim gap opening disposed on the front edge of the frame brim portion to receive air from the front of the frame brim portion through the hollow base frame and direct the air rearward through the frame brim portion toward the frame crown portion through the first and second side extensions; and the ventilated hat lacking a fan.

2. The ventilated hat of claim 1, in which the rear of the brim gap is adapted to open into an area between the wearer's head and the removable cover to allow a portion of the air flowing through the frame brim portion to flow over the wearer's head.

3. The ventilated hat of claim 1, in which the frame brim portion includes:

a lower brim element; and an upper brim element spaced apart from the lower brim element to form the brim gap between lower brim element and the upper brim element.

4. The ventilated hat of claim 3, in which the upper brim element, the lower brim element, or both the upper brim element and the lower brim element include a joint to facilitate bending the upper brim element, the lower brim element, or both the upper brim element and the lower brim element.

5. The ventilated hat of claim 1, in which the frame brim portion includes air flow guides.

6. The ventilated hat of claim 5, in which the air flow guides define air passages that decrease in cross section and then increase in cross section in the direction from the front of the brim to the rear of the brim.

7. The ventilated hat of claim 1, in which the hollow base frame includes a crown stub positioned at the rear of the frame brim portion and including an opening to pass air from the brim gap to the wearer's head.

8. The ventilated hat of claim 7, in which the first and second side extensions extend from the crown stub.

9. The ventilated hat of claim 1, in which the first side extension and the second side extension each includes:

air passages for guiding air from the brim gap through a portion of each side extension; and holes for allowing air from the air passages to enter the space between the crown portion and the wearer's head.

10. The ventilated hat of claim 1, in which the cover brim portion includes a pocket for inserting the structure of the base frame.

11. The ventilated hat of claim 1, in which the cover crown portion includes an opening for inserting the first side extension and an opening for inserting the second side extension.

12. The ventilated hat of claim 1, in which the removable cover is attached to the hollow base frame using fasteners.

13. The ventilated hat of claim 12, in which the fasteners comprise hook and loop fasteners or snap fasteners.

14. The ventilated hat of claim 1, further comprising at least one additional removable covers, the additional removable covers interchangeable to change the appearance of the hat.

15. The ventilated hat of claim 1, in which the frame brim portion or the cover brim portion includes a sheer fabric covering the brim gap.

16. A ventilated hat, comprising:

a single brim including:

a lower brim element;

an upper brim element spaced apart from the lower brim element, wherein the upper and lower brim elements are aligned to form the single brim with a hollow structure, and wherein the upper and lower brim elements create a brim gap opening between lower brim element and the upper brim element; and multiple brim air flow guides positioned in the brim gap opening to guide air flow in the brim gap opening from the front and sides of the brim to the crown; and a frame crown portion including:

a first side extension extending rearward on from one side of the single brim; and a second side extension extending rearward on from the other side of the single brim; and a crown including:

an inner crown element;

an outer crown element spaced apart from the inner crown element to create a crown gap between inner crown element and the outer crown element; and multiple crown air flow guides positioned in the crown gap to guide air flow in the crown gap;

the brim air flow guides guiding air entering the front of the single brim through the brim gap opening and directing the air rearward through the first and second side extensions toward the space between the inner crown element and the outer crown element and the crown airflow elements guiding the air adjacent the wearer's head.

17. The ventilated hat of claim 16 in which the ventilated hat includes at least one opening in the inner crown element, the at least one opening allowing air entering the hat through the brim to flow towards the wearer's head.

18. The ventilated hat of claim 16 in which the multiple brim air flow guides comprise a corrugated material positioned between the upper brim and the lower brim.

19. The ventilated hat of claim 16 in which the multiple brim air flow guides define air flow passages, the air flow passages having a width defined as normal to the air flow, the width of at least one of the air flow passages decreasing and then increasing from the front of the brim and to the back of the brim.

20. The ventilated hat of claim 16 in which the brim is configured to provide airflow without having a fan.

21. A kit comprising: the ventilated hat of claim 16; and multiple hat covers for removably attaching to the brim of the ventilated hat to change the appearance of the brim.

22. A ventilated hat, comprising:

a hollow single brim including:

a lower brim element; and an upper brim element spaced apart from the lower brim element, the upper element and the lower brim element defining a brim gap opening at the front of the hollow single brim between lower brim element and the upper brim element and extending from the front of the hollow single brim to back of the hollow single brim; and a frame crown portion including:

a first side extension extending rearward on from one side of the hollow single brim; and a second side extension extending rearward on from the other side of the hollow single brim; and a crown connected to the hollow single brim, the crown configured to allow air to flow from the brim gap opening through the hollow single brim and direct the air rearward through the hollow single brim and through the first and second extensions to the wearer's head.

23. The ventilated hat of claim 22 in which the crown is removable.

24. The ventilated hat of claim 22 further comprising multiple brim air flow guides positioned in the brim gap opening to guide air flow in the brim gap opening.

25. The ventilated hat of claim 22 in which the brim further comprises a fastener for attaching the crown onto the ventilated hat.

26. The ventilated hat of claim 22 in which the multiple brim air flow guides define air flow passages, the air flow passages having a width defined as normal to the air flow, the width of at least one of the air flow passages decreasing and then increasing from the front of the hollow single brim and to the back of the hollow single brim.

27. The ventilated hat of claim 22 in which the hollow single brim is configured to provide airflow without having a fan.

28. A method of providing a wearer's head protection from the sun while keeping the wearer's head cool, comprising:

providing a hat having a hollow single brim, a brim gap opening located at the front of the single hollow brim; a first side extension and a second side extension connected to the hollow single brim, and a crown, the hollow single brim having air passages that pass air from the brim gap opening in the front of the hollow single brim to the first and second side extensions to the crown; and causing air to flow through the hollow single brim and into the crown without the use of a fan.

29. The method of claim 28 in which causing air to flow through the hollow single brim and into the crown comprises causing air to flow by the wearer moving while wearing the hat, by convection, or by a breeze.

* * * * *